US009113541B2

(12) United States Patent
Weedon

(10) Patent No.: US 9,113,541 B2
(45) Date of Patent: Aug. 18, 2015

(54) VOLTAGE RIPPLE REDUCTION

(75) Inventor: Hans J. Weedon, Salem, MA (US)

(73) Assignee: Analogic Corporation, Peabody, MA (US)

( * ) Notice: Subject to any disclaimer, the term of this patent is extended or adjusted under 35 U.S.C. 154(b) by 576 days.

(21) Appl. No.: 13/341,362

(22) Filed: Dec. 30, 2011

(65) Prior Publication Data

US 2013/0170608 A1 Jul. 4, 2013

(51) Int. Cl.

| | |
|---|---|
| ***H05G 1/32*** | (2006.01) |
| ***H05G 1/50*** | (2006.01) |
| ***G05F 1/45*** | (2006.01) |
| ***H05G 1/10*** | (2006.01) |
| ***G05F 1/455*** | (2006.01) |
| ***H05G 1/58*** | (2006.01) |

(52) U.S. Cl.

CPC .. *H05G 1/10* (2013.01); *G05F 1/45* (2013.01); *G05F 1/455* (2013.01); *H05G 1/32* (2013.01); *H05G 1/50* (2013.01); *H05G 1/58* (2013.01)

(58) Field of Classification Search

CPC ..... H05G 1/00; H05G 1/02; H05G 1/08; H05G 1/10; H05G 1/265; H05G 1/30; H05G 1/32; H05G 1/50; G05F 1/10; G05F 1/40; G05F 1/45; G05F 1/455

USPC ..... 378/16, 91, 101, 104, 111, 112, 210, 378/901

See application file for complete search history.

(56) References Cited

U.S. PATENT DOCUMENTS

| | | | | |
|---|---|---|---|---|
| 4,168,436 | A * | 9/1979 | Aradate et al. | 378/16 |
| 4,532,644 | A * | 7/1985 | Yamaguchi et al. | 378/16 |
| 4,967,333 | A * | 10/1990 | Callier et al. | 363/17 |
| 5,210,780 | A * | 5/1993 | Schweighofer et al. | 378/105 |
| 5,661,774 | A * | 8/1997 | Gordon et al. | 378/101 |
| 5,668,464 | A * | 9/1997 | Krein et al. | 323/259 |
| 2006/0210020 | A1 * | 9/2006 | Takahashi et al. | 378/104 |

* cited by examiner

*Primary Examiner* — Anastasia Midkiff
(74) *Attorney, Agent, or Firm* — Cooper Legal Group LLC

(57) ABSTRACT

Among other things, one or more techniques and/or systems are described for reducing a voltage ripple in an electric signal. In this way, in radiographic imaging modalities, for example, undesired fluctuations in an output of a radiation source (e.g., undesirable fluctuations in an energy level of emitted photons) may be reduced. To reduce the voltage ripple, a (ripple reducing) electric signal is generated that comprises properties substantially similar to the voltage ripple, but opposite in phase. The (ripple reducing) electric signal is then combined with the original electric signal to generate a combined electric signal with a voltage ripple that is reduced relative to the voltage ripple of the electric signal as initially generated.

20 Claims, 6 Drawing Sheets

VOLTAGE RIPPLE REDUCTION

BACKGROUND

The present application relates to reducing voltage ripple of an electric signal. It finds application in the field of imaging modalities, and in particular, to imaging modalities that can employ multi-energy imaging techniques (e.g., where radiation is emitted at a plurality of distinct energy levels). For example, medical, security, and/or industrial applications may utilize a multi-energy (e.g., dual-energy) computed tomography (CT) scanner to discriminate objects based upon a plurality of characteristics (e.g., density, chemical composition (e.g., derived from z-effective information), etc.). It will be appreciated that while the present application finds particular applicability to multi-energy imaging techniques, it may also apply with respect to single-energy imaging techniques and/or to non-imaging applications.

Today, CT and other imaging modalities (e.g., single-photon emission computed tomography (SPECT), mammography, digital radiography, etc.) are useful to provide information, or images, of interior aspects of an object under examination. Generally, the object is exposed to radiation comprising photons (e.g., such as x-rays, gamma rays, etc.), and an image(s) is formed based upon the radiation absorbed and/or attenuated by the interior aspects of the object, or rather an amount of photons that is able to pass through the object. Typically, highly dense aspects of the object (e.g., or aspects of the object having a composition comprised of higher atomic number elements) absorb and/or attenuate more radiation than less dense aspects, and thus an aspect having a higher density (e.g., and/or high atomic number elements), such as a bone or metal, for example, will be apparent when surrounded by less dense aspects, such as muscle or clothing.

Radiographic imaging modalities generally comprise, among other things, one or more radiation sources (e.g., x-ray, gamma-ray, etc.) and a detector array comprised of a plurality of channels that are respectively configured to convert radiation that has traversed the object into signals that may be processed to produce the image(s). Such radiographic imaging modalities may be classified as single energy or multi-energy imaging systems based upon whether the imaging modality is configured to emit radiation at merely one energy level (e.g., or energy spectrum due to slight variations in the energy of emitted photons) or at two or more distinct energy levels (e.g., or two or more distinct energy spectra). Example applications for multi-energy imaging systems include, but are not limited to, bone densitometry, explosive detection, and/or quantitative CT, for example.

Multi-energy imaging systems employ numerous techniques to generate photons at two or more distinguishable energy levels and/or to discriminate between the energy levels of emitted photons when they are detected. One of the more common approaches is known as source switching, where the emitted radiation is alternated between at least two distinguished or different energy levels. Several techniques may be used to implement source switching. For example, in one approach, the voltage applied to a single radiation source is varied causing the emitted radiation's energy to vary with the change in voltage. In another approach, two or more spatially separated sources are configured to alternate radiation emissions (e.g., by alternating power to the sources). Where there are two energy sources, for example, one of the sources may be configured to emit higher energy radiation, while the other may be configured to emit lower energy radiation, for example.

Typically, electrical components that provide for transitioning between two or more voltage levels comprise, among other things, a high voltage power supply (e.g., which may comprise a transformer-rectifier combination) for generating an electric signal comprising a desired voltage and/or modifying an electric signal to comprise the desired voltage (e.g., where the desired voltage may change to alter an energy spectrum of radiation emitted). While the desired output of the power supply would be an electric signal having a constant voltage at a desired level, in practice power supplies (e.g., and in particular high voltage power supplies) often output an electric signal having a voltage that fluctuates within a range of the desired voltage. This is particularly true during a transition between two desired voltages, because the change in output current to support the changed voltage typically lags behind the change in voltage. This fluctuation may be referred to as a voltage ripple and may be undesirable because it may cause emitted photons to deviate (e.g., slightly) from a specific energy level (e.g., be emitted somewhat within an energy spectrum).

To reduce this fluctuation, voltage capacitors that are configured to dampen changes in voltage may be utilized. Typically, higher value capacitors are better at dampening voltage ripples than lower value capacitors. However, higher value capacitors also store more electric charge than lower value capacitors, and thus generally take longer to discharge than lower value capacitors. Thus, high value capacitors may prolong the transition between two or more voltage levels, which is typically undesirable in imaging modalities. It will be appreciated that while high voltage, fast discharging power-supplies do exist, such power-systems are rather expensive making the implementation of such power-systems generally cost prohibitive.

Therefore, it is a desire of this application to describe, among other things, one or more systems and/or techniques for reducing a voltage ripple yielded from an electric signal produced/modified by a power supply (e.g., comprising a high voltage transformer and a rectifier) while using lower value capacitors.

SUMMARY

Aspects of the present application address the above matters, and others. According to one aspect a system for reducing fluctuation in an output of a radiation source of an imaging modality is provided. The system comprises a waveform generator component configured to generate a second electric signal. The second electric signal is configured to be combined with a first electric signal generated by a power supply component to reduce a voltage ripple of the first electric signal and to yield a combined electric signal that when input into the radiation source of the imaging modality causes fluctuation in the output of the radiation source to be reduced relative to fluctuation in the output of the radiation source if the first electric signal were input into the radiation source.

According to another aspect, a method for reducing voltage ripple is provided. The method comprises generating a second electric signal via a waveform generator component that is configured to be combined with a first electric signal to generate a combined electric signal resulting in a voltage ripple that is reduced relative to a voltage ripple of the first electric signal.

According to yet another aspect, a computer readable medium comprising computer executable instructions that when executed via a processing unit perform a method for reducing voltage ripple. The method comprises generating a second electric signal via a waveform generator component that is configured to be combined with a first electric signal to generate a combined electric signal resulting in a voltage ripple that is reduced relative to a voltage ripple of the first electric signal.

Those of ordinary skill in the art will appreciate still other aspects of the present application upon reading and understanding the appended description.

FIGURES

The application is illustrated by way of example and not limitation in the figures of the accompanying drawings, in which like references generally indicate similar elements and in which.

DESCRIPTION

Figure 1:
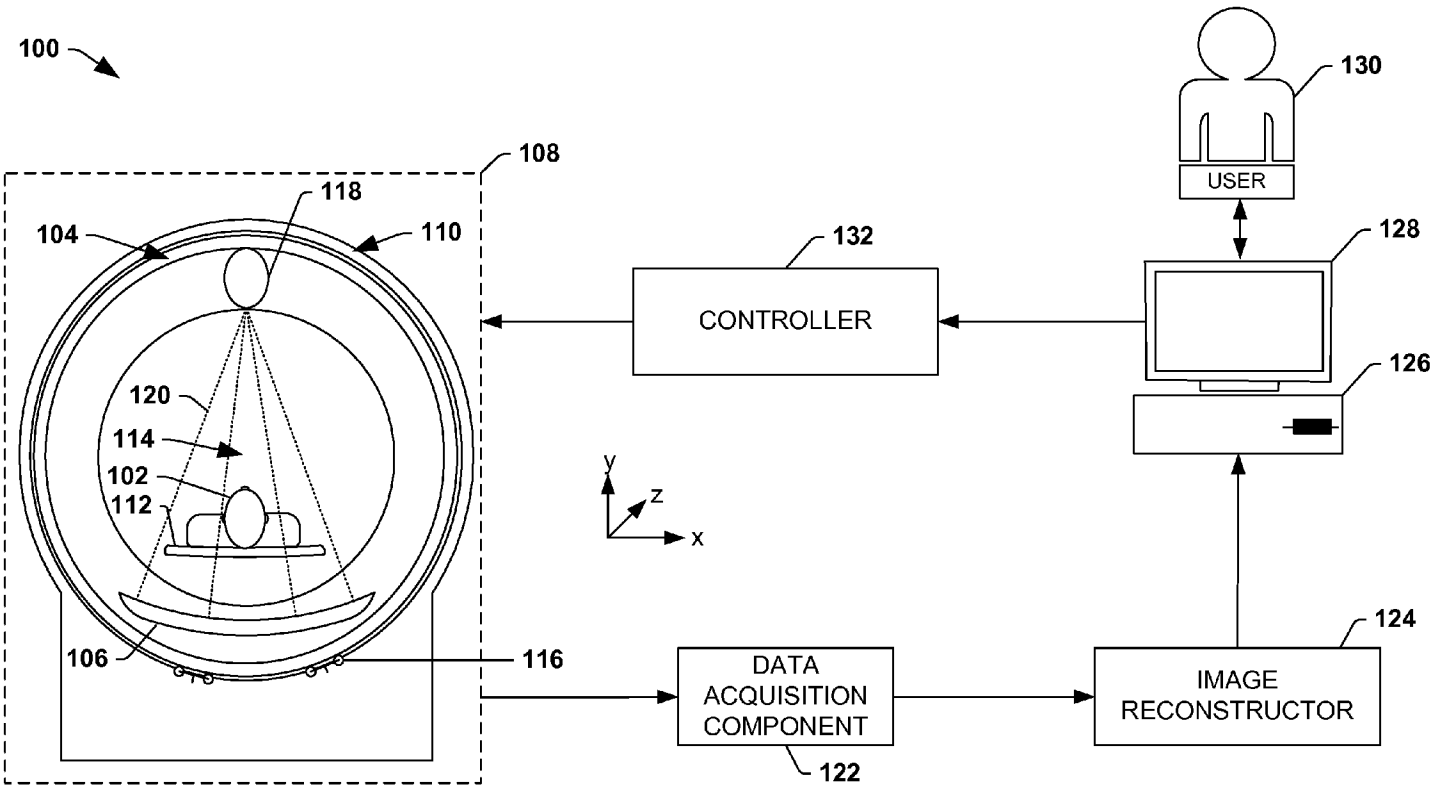
FIG. 1 is an example environment of an imaging modality.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are illustrated in block diagram form in order to facilitate describing the claimed subject matter.

Among other things, one or more systems and/or techniques are provided herein for reducing voltage ripple produced by a power supply (e.g., comprising a transformer and a rectifier). Such systems and/or techniques may be particularly useful for radiographic imaging modalities that vary a voltage applied to a radiation source to alter an energy level of emitted radiation and/or to alter an amount of radiation emitted (e.g., radiation flux). As will be described in more detail below, a voltage ripple of an electric signal is measured and/or predicted and a signal is produced therefrom that is intended to reduce (e.g., back out) the voltage ripple. In this way, the voltage applied to the radiation source may be held at a more constant level (e.g., reducing undesired fluctuations in the energy level of emitted radiation and/or undesired fluctuations in radiation flux).

FIG. 1 is an illustration of an example environment 100 of an example imaging modality that may be configured to generate data (e.g., images) representative of an object 102 or an aspect thereof under examination. It will be appreciated that the example configuration is merely intended to be representative of one type of imaging modality (e.g., a third-generation CT scanner) and is described herein merely to provide one example imaging modality. It will be appreciated that while the disclosure, including the scope of the claims, may find applicability with respect to imaging modalities (e.g., and in particular multi-energy imaging modalities), it is not intended to be limited to imaging modalities to the extract practical. Rather, it may apply to any application (e.g., high voltage application) where regulating/reducing a voltage ripple may be desirable.

In the example environment 100, an examination unit 108 of the imaging modality is configured to examine one or more objects 102. The examination unit 108 can comprise a rotating gantry 104 and a (stationary) support structure 110 (e.g., which may encase and/or surround as least a portion of the rotating gantry 104 (e.g., as illustrated with an outer, stationary ring, surrounding an outside edge of an inner, rotating ring)). During an examination of the object(s) 102, the object(s) 102 can be placed on a support article 112, such as a bed or conveyor belt, for example, that is selectively positioned in an examination region 114 (e.g., a hollow bore in the rotating gantry 104), and the rotating gantry 104 can be rotated and/or supported about the object(s) 102 by a rotator 116, such as a motor, drive shaft, chain, roller truck, etc.

The rotating gantry 104 may surround a portion of the examination region 114 and may comprise one or more radiation sources 118 (e.g., an ionizing x-ray source or other ionizing radiation source) and a detector array 106, comprised of a plurality of channels, that is mounted on a substantially diametrically opposite side of the rotating gantry 104 relative to the radiation source(s) 118.

During an examination of the object(s) 102, the radiation source(s) 118 emits fan, cone, wedge, and/or other shaped radiation 120 configurations from a focal spot(s) of the radiation source(s) 118 (e.g., a point within the radiation source(s) 118 from which radiation 120 emanates) into the examination region 114. It will be appreciated that such radiation 120 may be emitted substantially continuously and/or may be emitted intermittently (e.g., a brief pulse of radiation is emitted followed by a resting period during which the radiation source 118 is not activated).

The imaging modality may be single energy or multi-energy (e.g., dual energy). Single energy imaging modalities generally comprise a single radiation source configured to emit radiation at a first energy spectrum. Multi-energy imaging modalities generally comprise one or more radiation sources and are configured to emit radiation at a plurality of different energy levels via a source switching technique, for example. Generally, multi-energy imaging modalities provide additional information (e.g., relative to the information provided by a single energy imaging modality) that may be used to segment and/or identify portions of the object 102 under examination. For example, dual-energy CT scanners typically provide for discriminating aspects of an object 102 based upon density and atomic number characteristics, whereas single energy CT scanners generally provide for discriminating aspects of the object 102 based merely upon density.

As the emitted radiation 120 traverses the object(s) 102, the radiation 120 may be attenuated differently by different aspects of the object(s) 102. Because different aspects attenuate different percentages of the radiation 120, an image(s) may be generated based upon the attenuation, or variations in the number of photons that are detected by the detector array 106. For example, more dense aspects of the object(s) 102, such as a bone or metal plate, may attenuate more of the radiation 120 (e.g., causing fewer photons to strike the detector array 106) than less dense aspects, such as skin or clothing.

The detector array 106 can comprise a linear or two-dimensional array of channels disposed as a single row or multiple rows in the shape of a circular, cylindrical, or spherical arc, for example, typically having a center of curvature at the focal spot of the radiation source(s) 118, for example. As the rotating gantry 104 rotates, the detector array 106 is configured to directly convert (e.g., using amorphous selenium and/or other direct conversion materials) and/or indirectly convert (e.g., using photodetectors and/or other indirect conversion materials) detected radiation into analog signals.

Signals that are produced by the detector array 106 or rather by channels comprised in the detector array 106 may be transmitted to a data acquisition component 122 that is in operable communication with the detector array 106. Functions of the data acquisition component 122 may depend upon whether the detector array 106 is a charge integrating type detector array or a photon counting detector array. For example, with respect to a charge integrating detector array, the data acquisition component 122 may be configured to periodically sample the integrated analog signal(s) generated by respective channels of the detector array and generate a digital output signal representative of one or more characteristics (e.g., density, z-effective, etc.) of a portion of the object 102 being examined during a measuring interval. If the detector array is a photon counting detector array, the data acquisition component 122 may be configured to count a number of photons and/or energy level of photons detected by respective channels based upon the analog signals generated therefrom.

The collection of digital output signals generated by the data acquisition component 122 for a measuring interval and/or the number of photons counting during a measuring interval may be referred to as a "projection" or a "view". Moreover, an angular orientation of the rotating gantry 104 (e.g., and the corresponding angular orientations of the radiation source(s) 118 and the detector array 106) relative to the object(s) 102 and/or support article 112, for example, during generation of a projection may be referred to as the "projection angle."

The example environment 100 also illustrates an image reconstructor 124 that is operably coupled to the data acquisition component 122 and is configured to generate one or more images representative of the object 102 under examination based at least in part upon the digital output signals and/or counted photons using suitable analytical, iterative, and/or other reconstruction technique (e.g., tomosynthesis reconstruction, back-projection, etc.). Generally, respective images focus on a plane (e.g., or slice) of the object under examination 102.

The example environment 100 also includes a terminal 126, or workstation (e.g., a computer), configured to receive image(s) from the image reconstructor 124, which can be displayed on a monitor 128 to a user 130 (e.g., security personnel, medical personnel, etc.). In this way, the user 130 can inspect the image(s) to identify areas of interest within the object(s) 102. The terminal 126 can also be configured to receive user input which can direct operations of the object examination apparatus 108 (e.g., a speed of gantry rotation, an energy level of the radiation, etc.).

In the example environment 100, a controller 132 is operably coupled to the terminal 126. In one example, the controller 132 is configured to receive user input from the terminal 126 and generate instructions for the examination unit 108 indicative of operations to be performed.

It will be appreciated that the example component diagram is merely intended to illustrate one embodiment of one type of imaging modality and is not intended to be interpreted in a limiting manner. For example, the functions of one or more components described herein may be separated into a plurality of components and/or the functions of two or more components described herein may be combined into merely a single component. Moreover, the imaging modality may comprise additional components to perform additional features, functions, etc.

Figure 2:
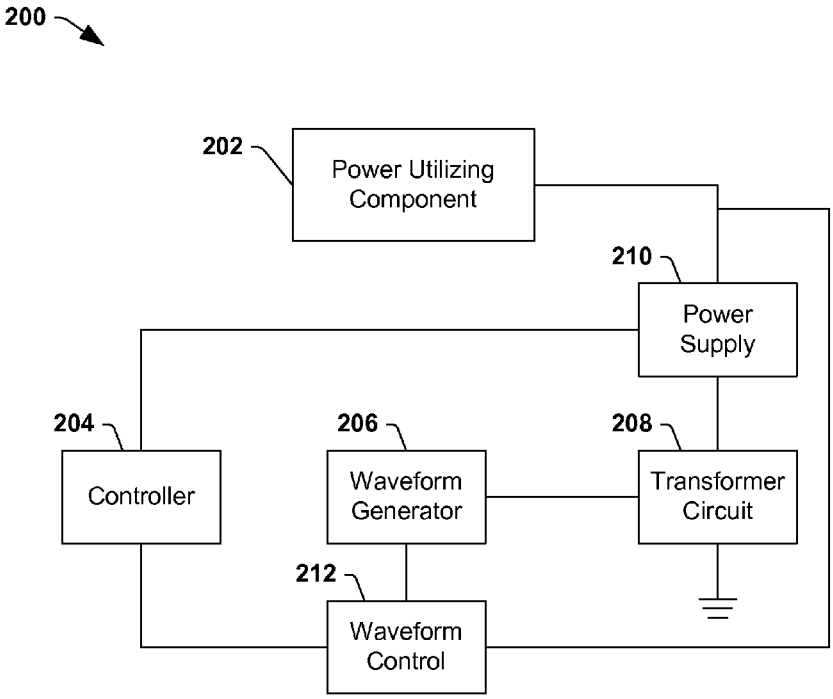
FIG. 2 illustrates an environment of a system configured to reduce voltage ripple in an electric signal applied to a power utilizing component.

FIG. 2 illustrates a component block diagram of an example environment 200 for reducing voltage ripple in an electric signal supplied to a power utilizing component 202. The example system comprises a controller component 204, a waveform generator component 206, a transformer circuit component 208, a power supply component 210, and a waveform control component 212.

The controller component 204 is configured to regulate the power output of the power supply component 210. That is, stated differently, the controller component 204 is configured to provide instructions to the power supply that cause the power supply component 210 to output an electric signal having desired properties (e.g., as specified by the controller component 204). For example, the controller component 204 may specify a desired power output and/or may specify desired properties of a signal output by the power supply component 210, such as a desired output voltage. In this way, the controller component 204 may instruct the power supply component 210 to increase and/or decrease a voltage of an output signal and/or to increase/decrease power output, for example.

The power supply component 210 is configured to generate an electric signal that can be transmitted to the power utilizing component 202. In one embodiment, the power supply component 210 is a high voltage, direct-current (DC) power supply configured to produce an electric signal that applies a voltage of at least 130 kV to the power utilizing component 202, although the power supply component 210 may produce an electric signal that is configured to apply less than 130 kV. Moreover, the power supply component 210 may be a low voltage power supply and/or may be an alternating current (AC) power supply.

In one embodiment, the power supply component 210 is not necessarily a power generator, but rather a power transformer. For example, in a CT imaging modality, the power supply component 210 may be a high voltage power transformer configured to transfer power from a stationary portion of the CT imaging modality to a rotating portion, although it may do more than merely transfer power. For example, the power supply component 210 may step-up or step-down a voltage relative to a voltage of an electric signal applied to (e.g., input into) the power supply component 210. Moreover, the power supply component 210 may comprise, among other things, a rectifier, for example, configured to convert an A/C signal output by the transformer (of the power supply component 210) to a DC signal that may be supplied to the power utilizing component 202, for example.

Generally, at times, there may be some variation in the voltage output of the power supply (e.g., relative to a desired output voltage). Such a variation may be referred to as a voltage ripple. For example, a power supply that is configured to (e.g., instructed to) increase an output voltage to 140 kV may, for a time, actually output a voltage that varies (e.g., in a substantially predictable manner) between 135 kV and 145 kV because a change in current necessary to support the increased voltage often lags behind the change in voltage. While in many applications this voltage ripple has little to no effect on the power utilizing component 202, in some applications, such a voltage ripple may cause noticeable (e.g., and at times undesirable) effects on the power utilizing component 202. For example, where the power utilizing component 202 comprises a radiation source, the voltage ripple may cause variations in the energy level of emitted radiation and/or variations in radiation flux. Because image reconstruction algorithms (e.g., used by an image reconstructor 124 in FIG. 1) rely upon knowledge of the energy level and/or flux of emitted radiation, such variations may have deleterious effects on images resulting therefrom. Thus, in some applications, such as in radiographic imaging applications, such a voltage ripple may be undesirable.

To reduce the voltage ripple of the signal output by the power supply 210, the example system comprises a waveform generator component 206, a transformer circuit component 208, and a waveform control component 212, although one or more of these components may be optional.

The waveform generator component 206 is configured to generate a signal (e.g., ripple reducing signal) that, when combined with the electric signal output by the power supply 210, is configured to reduce the voltage ripple of the electric signal output by the power supply. In this way, the signal that is supplied to the power utilizing component 202 (e.g., a combined signal yielded from combining the signal generated by the waveform generator component 206 with the signal generated by the power supply component 210) has little to no voltage ripple (e.g., the voltage of the combined signal is merely the desired voltage (e.g., although, in practice, some voltage ripple may remain)).

To reduce the voltage ripple in a signal produced by the power supply component 210, the waveform generator component 206 may be configured to generate a signal that is modulated at a frequency and/or amplitude that substantially matches the voltage ripple of the electric signal output by the power supply component 210, but is opposite in phase relative to the voltage ripple, and/or to generate a signal that comprises a current sufficient to support the voltage output by the waveform generator component 206. In this way, when the signal output by the power supply component 210 is combined with (e.g., added to) the signal output by the waveform generator component 206, the modulation of the signal output by the waveform generator component 206 reduces (e.g., to zero) the modulation of the voltage ripple in the signal output by the power supply component 210, such that the signal supplied to the power utilizing component 202 (e.g., the combined signal), has little to no voltage ripple.

It will be appreciated that although the voltage ripple may not be a perfect replica of the modulation (e.g., perfect sine wave), power supplies typically output a voltage ripple that follows a predictable path (e.g., the voltage ripple forms a distorted sine wave), where the path (e.g., modulation) is dependent upon, among other things, the desired output voltage (e.g., as specified by the controller 204). Stated differently, the voltage ripple forms a voltage waveform that varies in size/magnitude based upon the desired output voltage. For example, a desired output voltage of 140 kV may yield a voltage ripple that varies between 135 kV and 145 kV (e.g., plus or minus 5 kV from the desired output voltage), whereas a desired output voltage of 80 kV may yield a voltage ripple that varies between 78 kV and 82 kV (e.g., plus or minus 2 kV from the desired output voltage).

Given the predictability of the voltage ripple, in one embodiment, a waveform control component 212 may be configured to provide instructions to the waveform generator component 206 regarding desired output properties (e.g., amplitude and/or shape and/or frequency) based upon a desired output voltage of the power supply component 210, as specified by the controller 204, for example. Stated differently, the controller component 204, may provide the waveform control component 212 with information regarding the desired voltage output of the power supply component 210, and the waveform control component 212 may use that information to specify properties of the electric signal output by the waveform generator such that the electric signal output from the waveform generator component 206 is modulated in a manner that substantially matches (but is opposite in phase to) the voltage ripple output by the power supply component 210. Thus, the waveform control component 212 may determine desired properties (e.g., also referred to as characteristics) of a signal output by the waveform generator component 206 (e.g., including desired voltage and/or current to support the voltage) based upon a desired output voltage of the signal output by the power supply component 210.

To determine how a voltage ripple changes based upon a desired output voltage (e.g., to determine properties of the voltage ripple at various voltage levels), the waveform control component 212 and/or another component of the system, may perform a calibration to measure the voltage ripple of an electric signal output by the power supply 210 at given/specified output voltages during a calibration phase. For example, during a calibration phase, the controller component 204 may instruct the power supply component 210 to output an electric signal having one or more desired voltages (e.g., to be used by the power utilizing component 202 during a non-calibration phase), and the output of the power supply component 210 may be measured by the waveform control component 212 to determine a voltage ripple at respective desired voltage level(s). Alternatively, in another embodiment, the output of the power utilizing component 202 may be measured. For example, where the power utilizing component 202 is a radiation source, radiation energy and/or radiation flux (e.g., fluctuations thereof) may be measured to derive a voltage ripple of the electric signal that is applied to the power utilizing component 202.

Once the modulation rate (e.g., frequency and/or amplitude of the voltage ripple) is determined, the waveform control component 212 may use the measurements of the voltage ripple to determine corresponding properties for a signal output by the waveform generator component 206 that would reduce the voltage ripple of the signal output by the power supply component 210 and/or that would supply a current that is substantially sufficient to support the voltage.

Moreover, to verify that the waveform generator component 206 generates a signal that reduces the voltage ripple (e.g., to substantially zero), the waveform generator component 206 may produce an electric signal comprising the determined corresponding properties to test whether an electric signal comprising the determined properties does, in fact, reduce the voltage ripple as desired. If the voltage ripple is increased and/or is decreased by less than a predetermined threshold (e.g., 80%), the signal properties (e.g., voltage and/or supporting current) of the signal output by the waveform generator component 206 may be adjusted (e.g., tuned) by the waveform control component 212 to further reduce the voltage ripple generated by the power supply component 210 when an electric signal having a given output voltage is desired.

In another embodiment of a calibration process, desired properties of a signal output by the waveform generator component 206 may be determined via a successive approximation technique. For example, the waveform generator component 206 may output a second signal (e.g., ripple reducing signal), which may be combined with (e.g., added to) the signal output by the power supply component 210 and measured to determine its effect on the voltage ripple. Properties of the signal output by the waveform generator component 206 may then be adjusted, and the process may be repeated until the signal output by the waveform generator component 206 reduces the voltage ripple below a desired threshold.

Such a calibration process(es) may be repeated for respective desired output voltages to generate a table, for example, indicating signal properties (e.g., voltages and/or supporting currents) for signals output by the waveform generator component 206 at respective desired output voltages. In this way, during a non-calibration phase, for example, the waveform control component 212 may be aware of how to adjust the output signal of the waveform generator component 206 based upon a desired output voltage of an electric signal output by the power supply component 210. For example, in one embodiment, the controller component 204 may periodically increase and/or decrease a desired output voltage of the electric signal output by the power supply component 210, which may, in turn, alter the voltage ripple of the electric signal. Thus, when the controller component 204 request a change in output voltage (e.g., from 140 kV to 80 kV), the waveform control component 212 may instruct the waveform generator component 206 to adjust properties of its output signal (e.g., from 5 kV to 2 kV) (e.g., based upon the table of properties) to correspond to changes in the voltage ripple (e.g., from variations between 135 kV and 145 kV to variations between 78 kV and 82 kV) that result from the change in desired output voltage.

In another embodiment, the voltage ripple of the signal output by the power supply component 210 may be measured (e.g., during a non-calibration phase) by the waveform control component 212, and the waveform generator component 206 may output a signal reflecting a change to one or more properties based upon changes in the measured voltage ripple. For example, in one embodiment, the waveform control component 212 can be configured to measure the voltage ripple output by the power supply component 210 and to determine properties of a signal output by the waveform generator component 206 (e.g., voltage and/or supporting current) that would reduce the voltage ripple. Such determined properties may be relayed to the waveform generator component 206 by the waveform control component 212, for example, causing the waveform generator component 206 to generate an output signal having the determined properties. In this way, the waveform control component 212 receives an electric signal from the power supply component 210 and outputs a command to the waveform generator component 206 indicative of desired properties of a signal the waveform generator component 206 is to output.

The example environment 200 of an example system further comprises a transformer circuit component 208 configured to couple the waveform generator component 206 to the power supply component 210 such that the signal output by the waveform generator component 206 can be combined with the electric signal output by the power supply component 210. In one embodiment, the transformer circuit component 208 is also configured to provide isolation between the power supply component 210 and the waveform generator component 206. That is, in one embodiment, the transformer circuit component 208 is configured to isolate the electric signal of the power supply component 210 from the waveform generator component 206 (e.g., such that the signal produced by the waveform generator component 206 is fed into the transformer circuit component 208 and combined with the electric signal produced by the power supply component 210). By way of example, in a radiographic imaging modality application, the power utilizing component 202 (e.g., a radiation source) may produce an arc that could damage the waveform generator component 206. Therefore, the transformer circuit component 208 may be configured to isolate the waveform generator component 206 to reduce the possibility of the arc reaching the waveform generator component 206.

It will be appreciated that example schematics of at least some of the waveform generator component 206, the transformer circuit component 208 and/or the power supply component 210 may be described in U.S. Pat. No. 5,661,774, assigned to Analogic Corporation, at least some of which may be incorporated herein by reference.

Figure 3:
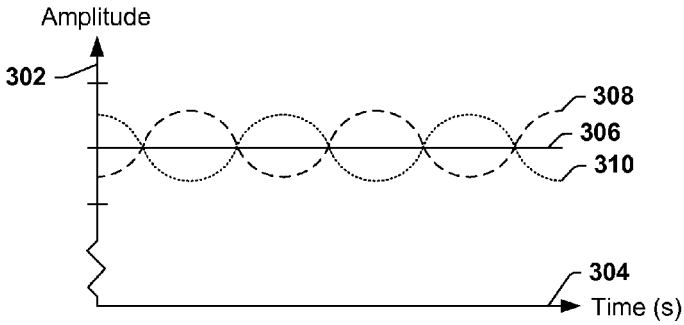
FIG. 3 is an example graph illustrating a reduction in voltage ripple.

FIG. 3 illustrates an example line graph illustrating modulation rates (e.g., amplitude 302 vs. time 304) of a desired voltage output 306, a voltage ripple 308 (e.g., which is output from a power supply component (e.g., 210 in FIG. 2) when the desired voltage output is specified (e.g., by a controller component (e.g., 204 in FIG. 2)), and a signal 310 (e.g., produced by a waveform generator component (e.g., 206 in FIG. 2)) that is configured to reduce the voltage ripple 308. The voltage ripple 308 typically fluctuates in a predicable manner such that the signal 310 may be produced that substantially reduces the voltage ripple 308 (e.g., to nearly zero) when added to the voltage ripple 308, bringing the voltage ripple 308 in-line with the modulation rate of the desired voltage output 306. For example, in the illustrated embodiment, the voltage ripple 308 substantially forms a sine wave, so the signal 310 may be an inverse polarity sine wave (e.g., a waveform substantially similar to the voltage ripple 308 but opposite in phase (e.g., such that the signal 310 substantially mirrors the voltage ripple 308)).

Figure 4:
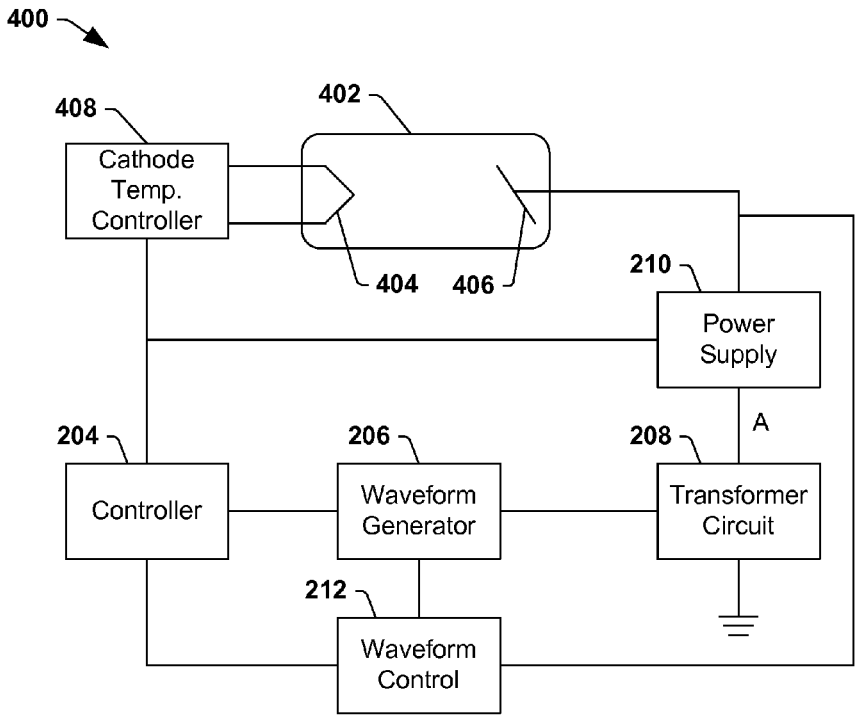
FIG. 4 illustrates an environment of a system configured to reduce fluctuations in an output of a radiation source.

FIG. 4 illustrates a component block diagram of an example environment 400 for reducing fluctuation in an output of a radiation source 402 (e.g., 202 in FIG. 2, 118 in FIG. 1)) by reducing a voltage ripple in an electric signal supplied to the radiation source 402. It will be appreciated that for purposes of brevity, for example, components that perform functions similar to those described with respect to FIG. 2 (e.g., and labeled using similar reference characters), may not be described as fully (e.g., if at all), with respect to FIG. 4.

The radiation source 402 may be a typical hot cathode type source that comprises a cathode-structure 404, comprising a filament, and an anode 406. In such a radiation source 402, the energy spectrum or spectra of radiation generated by the source 402 is typically a function of the voltage applied to the cathode-structure 404 relative to the anode 406. The radiation flux generated by the source 402 is typically a function of the electron current flowing from the cathode-structure 404 to the anode 406, which, in turn, is a function of the temperature of the cathode-structure 404. Thus, to control the radiation flux generated by the source 402, the example environment 400 illustrates a cathode temperature controller component 408 configured to control the temperature of the cathode-structure 404 (e.g., and/or a filament of the cathode-structure 404) based upon information received from the controller component 204 (e.g., configured to specify a desired radiation flux and/or a desired temperature of the cathode 404).

The power supply component 210 may be configured to supply power to the anode 406, the cathode-structure 404, and/or both the cathode-structure 404 and the anode 406 (e.g., as may be further described in U.S. Pat. No. 5,661,774). Moreover, by varying the voltage applied to the cathode-structure 404 and/or the anode 406, the energy spectrum or spectra of emitted radiation may be varied (e.g., to generate multi-energy images and/or generate images illustrating at least two (independent) variables, such as density and atomic number).

As describes above, when the power supply component 210 outputs an electric signal, the voltage of the signal may, at times, fluctuate relative to a desired output voltage (e.g., particularly during an interval at or near a change in the desired output voltage), causing some photons to be emitted at energy levels other than desired. To reduce this fluctuation, the waveform generator component 206 outputs a signal (e.g., ripple reducing signal) with substantially similar properties, but substantially opposite in phase, relative to the voltage ripple produced by the power supply component 210. This signal output by the waveform generator component 206 is combined with (e.g., added to) the signal produced by the power supply component 210 (e.g., at the transformer circuit 208 and/or at the label "A"), to reduce the voltage ripple of the signal produced by the power supply component 210. This combined signal may then be fed to the radiation source 402. In this way, the voltage applied to the radiation source 402 is substantially constant (e.g., at least relative to the voltage output by the power supply component 210), causing the fluctuation in the output of the radiation source 402 (e.g., causing fluctuation in the energy level of photons emitted by the radiation source 402) to be reduced. Moreover, it will be appreciated that at times when the voltage ripple output by the power supply component 210 falls below a predetermined threshold (e.g., because the current output by the power supply component 210 is sufficient to support the voltage output by the power supply component 210), the waveform generator component 206 may be turned off and/or the signal output therefrom may not be combined with the signal output from the power supply component 210, for example.

Figure 5:
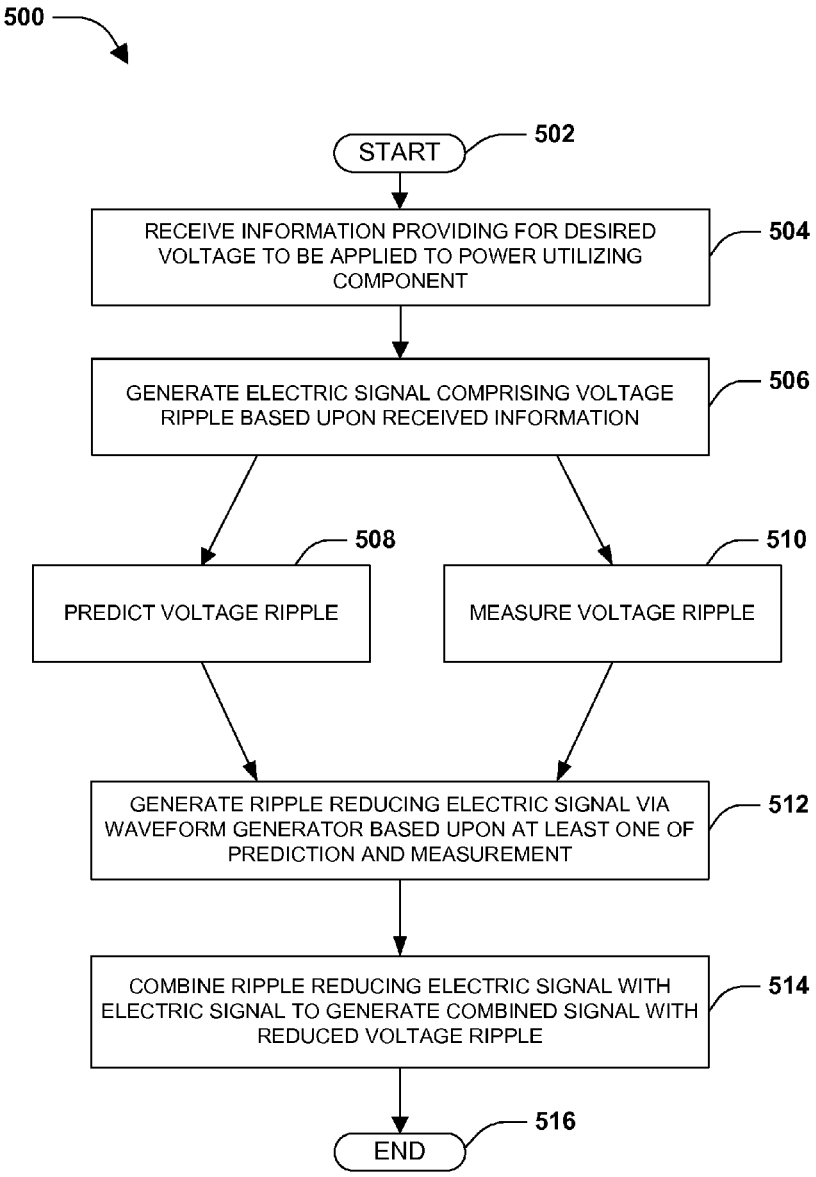
FIG. 5 illustrates an example method for reducing voltage ripple.

FIG. 5 illustrates an example method 500 for reducing voltage ripple in an electric signal produced by a power supply, such as a high voltage power supply (e.g., high voltage transformer). In this way, the voltage applied to a power utilizing component, such as a radiation source, may be made more constant to reduce (e.g., to substantially zero) undesired fluctuations in an energy level of photons emitted therefrom, for example.

The example method 500 begins at 502, and information providing for a desired voltage to be applied to a power utilizing component is received at 504. As an example, in a radiographic imaging modality, the energy level of radiation may be a function of, among other things, a voltage applied to a radiation source. Thus, the received information may specify a voltage in order to cause the radiation source, to which the voltage is applied, to emit radiation at a desired energy level.

At 506 in the example method 500, a first electric signal comprising a voltage ripple is generated based upon the received information. That is, as described above, a power supply (e.g., such as a high voltage transformer) may, at times, be unable to output an electric signal having a constant voltage (e.g., because the current output by the power supply is insufficient to support the voltage output by the power supply). Rather, the electric signal that is output by the power supply comprises some fluctuation in the voltage, which may be referred to as a voltage ripple. As stated above, while in some applications, such a voltage ripple has little to no effect on a power utilizing component that is configured to utilize the first electric signal, in other applications (e.g., such as in radiographic imaging modalities), the voltage ripple may affect the power utilizing component(s).

Therefore, in one embodiment of the example method 500, based upon the received information (e.g., specifying a desired output voltage of the first electric signal), the voltage ripple of the first electric signal is predicted at 508, a second electric signal is generated (e.g., via a waveform generator component) based at least in part upon the prediction at 512, and the second electric signal (e.g., ripple reducing signal) is combined with the first electric signal at 514 to generate a combined signal with a reduced voltage ripple relative to the voltage ripple of the first electric signal. As described with respect to FIG. 3, the shape (e.g., amplitude and frequency) of a voltage ripple can typically be predicable based upon the desired output voltage. That is, generally speaking, the shape of the voltage ripple is a function of the desired output voltage (e.g., and the shape will be substantially the same each time the same output voltage is specified). Therefore, as a function of the desired voltage, which may be included in the received information at 504, the voltage ripple of the first electric signal may be predicted and a second electric signal, configured to reduce the voltage ripple (e.g., by having properties similar to the voltage ripple but substantially opposite in phase) may be generated. That is, a second electric signal comprising a voltage the reduces the voltage of the first electric signal and/or comprising a current sufficient to support the voltage of the second electric signal and/or sufficient to support a voltage of the combined signal may be predicted based upon the desired output voltage (e.g., and the given power supply).

Moreover, as described above, to predict the voltage ripple of the first electric signal during a non-calibration phase (e.g., when an object is being examined by an imaging modality), the voltage ripple of the first electric signal at various desired output voltages may be measured during a calibration phase and properties (e.g., frequency and/or amplitude) of the voltage ripple may be determined for respective desired output voltages. Subsequently, during a non-calibration phase, the voltage ripple (e.g., or properties thereof) of the first electric signal may be predicted based upon the desired output voltage and/or the properties of the voltage ripple for the desired output voltage that were determined during the calibration.

Yet another way to determine properties for a second electric signal that when combined with the first electric signal generates a combined electric signal with a reduced voltage ripple relative to the voltage ripple of the first electric signal is to measure the voltage ripple of the first electric signal at 510 and generate a second electric signal based upon the measurement at 512. In such an embodiment, the voltage ripple of the first electric signal may be known prior to the generation of the second electric signal, so no prediction (and/or calibration) may be necessary.

In yet another embodiment, the second electric signal may be generated at 512 based upon a combination of the prediction and measurement of the first electric signal. For example, upon information being received at 504, both a first electric signal and a second electric signal may be generated, where the second electric signal is generated based upon a predicted voltage ripple of the first electric signal. Subsequently, the voltage ripple of the first electric signal may be measured, and properties of the second electric signal may be adjusted (e.g., fine-tuning the properties of the second electric signal based upon the actual voltage ripple as opposed to the predicted voltage ripple).

In yet another embodiment, the combined signal generated at 514 may be measured (e.g., to measure residual voltage ripple) prior to being applied to a power utilizing component (e.g., such as a radiation source), for example, and the properties of the second electric signal may be adjusted (e.g. fine-tuned) to further reduce the voltage ripple of the combined signal, for example.

When and/or if the voltage ripple produced by the power supply is reduced below a specified threshold (e.g., because the current output by the power supply is sufficient to support the voltage output by the power supply), generation of the ripple reducing signal may cease and/or be reduced. As an example, in one embodiment, a waveform control component may measure the voltage ripple. When the waveform control component determines that the voltage ripple has dropped below a specified threshold, it may notify a waveform generator component (e.g., 206 of FIG. 2) to stop generating the ripple reducing signal. In another embodiment, the waveform control component may be aware, based upon a calibration phase, of the length of time is takes for the current that is output by the power supply to increase and/or decrease (e.g., upon a change in the desired voltage from a first voltage level to a second voltage level), so the waveform control component may not measure the voltage ripple (e.g., to detect when the voltage ripple drops below a specified threshold).

The example method 500 ends at 516.

Figure 6:
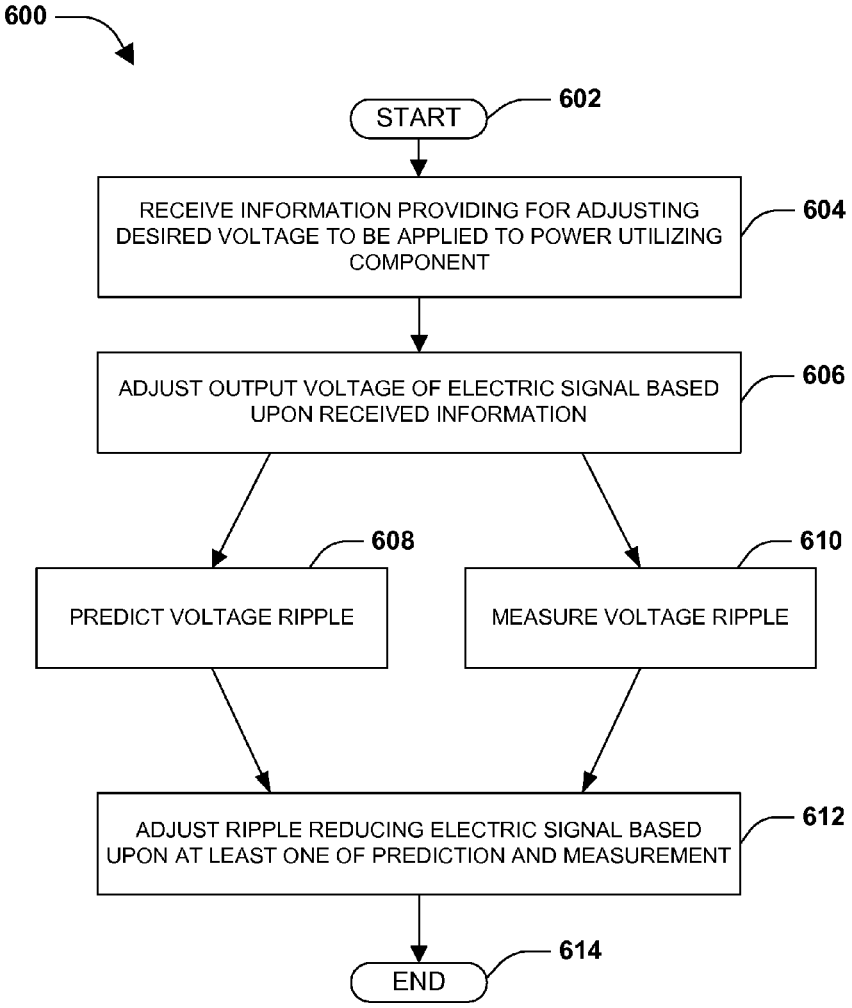
FIG. 6 illustrates an example method for adjusting one or more properties of an electric signal to reduce voltage ripple.

FIG. 6 illustrates an example method 600 for adjusting one or more properties of a second electric signal (e.g., ripple reducing signal) based upon an adjustment to a desired voltage output of a first electric signal. The example method 600 begins at 602, and second information providing for adjusting a desired voltage to be applied to a power utilizing component is received at 604. For example, in a multi-energy imaging modality, the voltage applied to a radiation source may be varied between two or more energy levels. Thus, the received second information may provide for increasing or decreasing a voltage of an electric signal generated by a power supply to increase or decrease the energy of radiation emitted by a radiation source, for example.

At 606 in the example method 600, the output voltage of a first electric signal is adjusted based upon the received second information. It will be appreciated that when the output voltage of the first electric signal is adjusted, the voltage ripple of the first electric signal may also be adjusted. Therefore, at 608 in the example method 600, the voltage ripple of the adjusted electric signal is predicted, and/or at 610 in the example method 600, the voltage ripple of the adjusted electric signal is measured.

Based upon the predicted and/or measured voltage ripple of the adjusted electric signal, one or more properties of the second electric signal (e.g., ripple reducing signal) may be adjusted at 612 to correspond to changes in properties of the voltage ripple that resulted from the adjustment to the output voltage of the first electric signal. In this way, when the second electric signal, as adjusted, is combined with the first electric signal, as adjusted, the combined signal maintains a voltage ripple that is less than the voltage ripple of the first electric signal, as adjusted, for example.

The example method 600 ends at 614.

Figure 7:
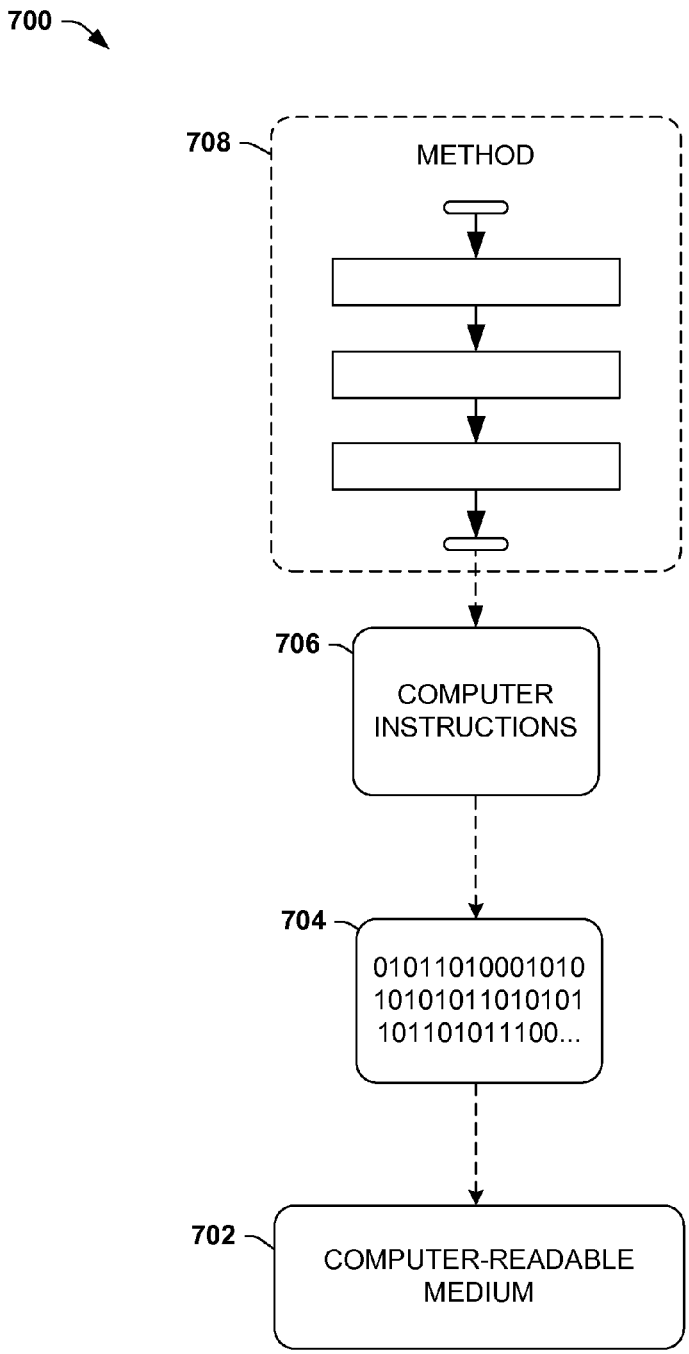
FIG. 7 is an illustration of an example computer-readable medium comprising processor-executable instructions configured to embody one or more of the provisions set forth herein.

Still another embodiment involves a computer-readable medium comprising processor-executable instructions configured to implement one or more of the techniques presented herein. An example computer-readable medium that may be devised in these ways is illustrated in FIG. 7, wherein the implementation 700 comprises a computer-readable medium 702 (e.g., a flash drive, CD-R, DVD-R, or a platter of a hard disk drive), on which is encoded computer-readable data 704. This computer-readable data 704 in turn comprises a set of computer instructions 706 configured to operate according to one or more of the principles set forth herein. In one such embodiment 700, the processor-executable instructions 706 may be configured to perform a method 708, such as at least some of the example method 500 of FIG. 5 and/or the example method 600 of FIG. 6, for example. In another such embodiment, the processor-executable instructions 706 may be configured to implement a system, such as at least some of the exemplary systems 100, 200, and 400 of FIGS. 1, 2, and 4, respectively, for example. Many such computer-readable media may be devised by those of ordinary skill in the art that are configured to operate in accordance with one or more of the techniques presented herein.

Moreover, the words "example" and/or "exemplary" are used herein to mean serving as an example, instance, or illustration. Any aspect, design, etc. described herein as "example" and/or "exemplary" is not necessarily to be construed as advantageous over other aspects, designs, etc. Rather, use of these terms is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims may generally be construed to mean "one or more" unless specified otherwise or clear from context to be directed to a singular form. Also, at least one of A and B or the like generally means A or B or both A and B.

Although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated example implementations of the disclosure. Similarly, illustrated ordering(s) of acts is not meant to be limiting, such that different orderings comprising the same of different (e.g., numbers) of acts are intended to fall within the scope of the instant disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. A system for reducing fluctuation in an output of a radiation source of an imaging modality, comprising:

a waveform control component configured to:

receive information regarding a desired voltage to be applied to the radiation source;

determine a desired property of a second electric signal, generated by a waveform generator component, based upon the information; and notify the waveform generator component of the desired property; the waveform generator component configured to:

generate the second electric signal, the second electric signal having the desired property and combined with a first electric signal generated by a power supply component to yield a combined electric signal having a reduced voltage ripple relative to a voltage ripple of the first electric signal, the combined electric signal input into the radiation source; and a transformer circuit configured to electrically isolate the waveform generator component from the first electric signal, the second electric signal transmitted through the transformer circuit prior to being combined with the first electric signal.

2. The system of claim 1, the imaging modality comprising a CT scanner.

3. The system of claim 1, the imaging modality comprising a dual-energy CT scanner.

4. The system of claim 1, the waveform control component configured to compare the information to information comprised within a lookup table to determine the desired property.

5. The system of claim 4, the waveform control component configured to generate at least some of the information comprised within the lookup table based upon radiation flux measured during a calibration procedure.

6. The system of claim 4, the waveform generator component configured to generate at least some of the information comprised within the lookup table based upon a measured voltage ripple of an electrical signal, generated by the power supply component and having the desired voltage, during a calibration procedure.

7. The system of claim 1, the waveform control component configured to:

measure the voltage ripple of the first electric signal; and adjust the desired property of the second electric signal based upon the voltage ripple of the first electric signal to generate an adjusted property for the second electric signal.

8. The system of claim 1, the power supply component configured to output a high voltage DC signal.

9. The system of claim 1, the power supply component configured to alternate a voltage of the first electric signal between at least two different voltages.

10. The system of claim 1, the waveform control component configured to:

measure the voltage ripple of the combined electric signal; and adjust the desired property of the second electric signal based upon the voltage ripple of the combined electric signal to generate an adjusted property for the second electric signal.

11. The system of claim 1, the radiation source comprising an ionizing radiation source.

12. A method for reducing voltage ripple, comprising:

receiving information regarding a desired voltage to be applied to a radiation source;

comparing the information to information comprised within a lookup table to determine a desired property of a second electric signal;

generating the second electric signal based upon the desired property;

combining the second electric signal with a first electric signal to yield a combined electric signal having a reduced voltage ripple relative to a voltage ripple of the first electric signal; and inputting the combined electrical signal into the radiation source.

13. The method of claim 12, comprising:

measuring the voltage ripple of the combined electric signal; and adjusting the desired property of the second electric signal based upon the voltage ripple of the combined electric signal to generate an adjusted property for the second electric signal.

14. The method of claim 12, comprising:

generating at least some of the information comprised within the lookup table based upon radiation flux measured during a calibration procedure.

15. The method of claim 12, comprising:

generating at least some of the information comprised within the lookup table based upon a measured voltage ripple of an electric signal having the desired voltage and generated during a calibration procedure.

16. The method of claim 12, comprising:

measuring the voltage ripple of the first electric signal; and adjusting one or more properties of the second electric signal based upon the voltage ripple of the first electric signal.

17. The method of claim 12, the second electric signal having a voltage ripple that is opposite in phase to the voltage ripple of the first electric signal.

18. The method of claim 16, the adjusting comprising:

adjusting one or more properties of the second electric signal based upon the measuring if the voltage ripple of the first electrical signal exceeds a threshold.

19. A computer readable medium comprising computer executable instructions that when executed via a processing unit perform a method for reducing voltage ripple, the method comprising:

receiving information regarding a desired voltage to be applied to a radiation source;

comparing the information to information comprised within a lookup table to determine a desired property of a second electric signal;

generating the second electric signal based upon the desired property;

combining the second electrical signal with a first electric signal to yield a combined electric signal having a reduced voltage ripple relative to a voltage ripple of the first electric signal; and inputting the combined electrical signal into the radiation source.

20. The system of claim 1, wherein the voltage ripple of the first electric signal is at least 1 kV.

* * * * *